US005267469A

United States Patent [19]

Espinoza

[11] Patent Number: 5,267,469

[45] Date of Patent: Dec. 7, 1993

[54] METHOD AND APPARATUS FOR TESTING THE PHYSICAL INTEGRITY OF PRODUCTION TUBING AND PRODUCTION CASING IN GAS-LIFT WELLS SYSTEMS

[75] Inventor: Jose A. Espinoza, Edo Lara, Venezuela

[73] Assignee: Lagoven, S.A., Caracas, Venezuela

[21] Appl. No.: 859,853

[22] Filed: Mar. 30, 1992

[51] Int. Cl.[5] ..... G01M 3/28

[52] U.S. Cl. ..... 73/40.5 R; 73/49.5; 73/151

[58] Field of Search ..... 73/151, 37, 40.5 R, 73/49.1, 49.5, 49.8; 166/114, 115, 192, 193, 250, 252, 337

[56] References Cited

U.S. PATENT DOCUMENTS

| | | | |
|---|---|---|---|
| 2,545,102 | 3/1951 | Miller | 73/40.5 R |
| 2,955,458 | 10/1960 | Sonnier et al. | 73/49.5 |
| 4,046,006 | 9/1977 | DuFrene | 73/151 |
| 4,182,159 | 1/1980 | Churchman | 73/40.5 R |
| 4,474,053 | 10/1984 | Butler | 73/40 |
| 4,804,042 | 2/1989 | Knight et al. | 166/192 |
| 5,031,697 | 7/1991 | Wellington et al. | 73/40.5 R |

*Primary Examiner*—Hezron E. Williams
*Assistant Examiner*—Michael J. Brook
*Attorney, Agent, or Firm*—Bachman & LaPointe

[57] ABSTRACT

A method for testing physical integrity of production tubing and production casing in a gas-lift well includes the steps of opening communication from a pressure source to an interior space of the production tubing; disposing a sealing tool in the production tubing to obtain a seal at a desired location of the production tubing; opening communication from an inner annular space of the well; applying a predetermined test pressure to the interior space of the production tubing; monitoring the test pressure applied for a pressure drop; and monitoring flow from the inner annular space. The physical integrity of the production casing is then tested by opening communication from a pressure source to the inner annular space; closing communication from the interior space of the production tubing; applying a predetermined test pressure to the inner annular space; and monitoring the test pressure for a pressure drop.

17 Claims, 2 Drawing Sheets

METHOD AND APPARATUS FOR TESTING THE PHYSICAL INTEGRITY OF PRODUCTION TUBING AND PRODUCTION CASING IN GAS-LIFT WELLS SYSTEMS

BACKGROUND OF THE INVENTION

The invention relates to a method and apparatus for testing physical integrity of production tubing and production casing in gas-lift well systems.

The production of hydrocarbons from subterranean formations results in a reduction of pressure in the formation. This formation pressure drives the production of the hydrocarbons during the primary production period of the well, by providing a pressure differential which forces fluids to be produced up out of the well and into the various flow lines located at the surface of the well. When the pressure at the formation drops to the point where it can no longer drive the production of hydrocarbons to the surface, secondary techniques are frequently used to provide the necessary energy to the hydrocarbons to bring them to the surface. One method of secondary recovery, called gas-lift, is carried out by injecting gas into the production tubing at various points to increase the subsurface pressure and drive the production of fluids to the surface.

In situations where gas-lift is to be used, regulations frequently require that the system be tested to ensure an absence of leaks from the well into surrounding formations such as aquifers. Further, because the gas used to drive the production has a value, and because the gas may contain components which are harmful to the crew working the well, additional incentive exists for ensuring the integrity of both production tubing and production casing of the well to which gas-lift is to be applied.

Various technologies are known in the art which provide methods for testing integrity of the production tubing. These procedures, however, cannot be used to test the integrity of the casing of the well without removal of either the production tubing or various gas-lift equipment which may be affixed to the production tubing. Removal of this equipment, (mandrels, for example, through which gas passes into the production tubing), requires increased down time of the producing well, as well as the use of technologically trained personnel, resulting in prohibitive costs.

U.S. Pat. No. 4,182,159 discloses a pressure testing tool which can be activated at a desired location in tubing in order to allow pressure testing of a particular section of the tubing. No disclosure is made, however, of any method to be used for such pressure testing.

It is, accordingly, a principal object of the present invention to provide a method and apparatus for testing the physical integrity of production tubing and production casing wherein integrity of the production casing can be tested and removal of gas-lift hardware such as mandrels and other completion equipment is minimized.

SUMMARY OF THE INVENTION

The aforesaid object, and others, are accomplished through a method comprising the steps of: opening communication from a pressure source to an interior space of the production tubing; disposing means for sealing the production tubing at a desired location in the production tubing; opening communication from an inner annular space, defined between the production tubing and the production casing; applying a predetermined test pressure to the interior of the production tubing; monitoring the test pressure for a pressure drop; and monitoring flow from the inner annular space.

The integrity of the production casing can then be determined through a method comprising the steps of: opening communication from a pressure source to the inner annular space; closing communication from the interior space of the production tubing; applying a predetermined test pressure to the inner annular space; and monitoring the test pressure for pressure drops.

The production tubing can be closed to flow to and from the formation for the aforesaid testing, according to the invention, through the use of a device for obtaining a seal at a desired location of a production tubing during the testing of production tubing and production casing of a well, wherein the desired location has a reduced inside diameter, comprising a shaft member, a ball-shaped member attached to the shaft member and having a diameter smaller than an inside diameter of the production tubing and larger in diameter than the reduced inside diameter of the desired location of the production tubing; and means for centralizing the sealing tool in the production tubing; the centralizing means being affixed to the shaft member.

BRIEF DESCRIPTION OF THE DRAWINGS

A detailed description of the preferred embodiments of the present invention follows, with reference to the accompanying drawings, wherein.

DETAILED DESCRIPTION OF THE INVENTION

With reference to the attached drawings, a detailed description of the preferred embodiments will be given.

Figure 1:
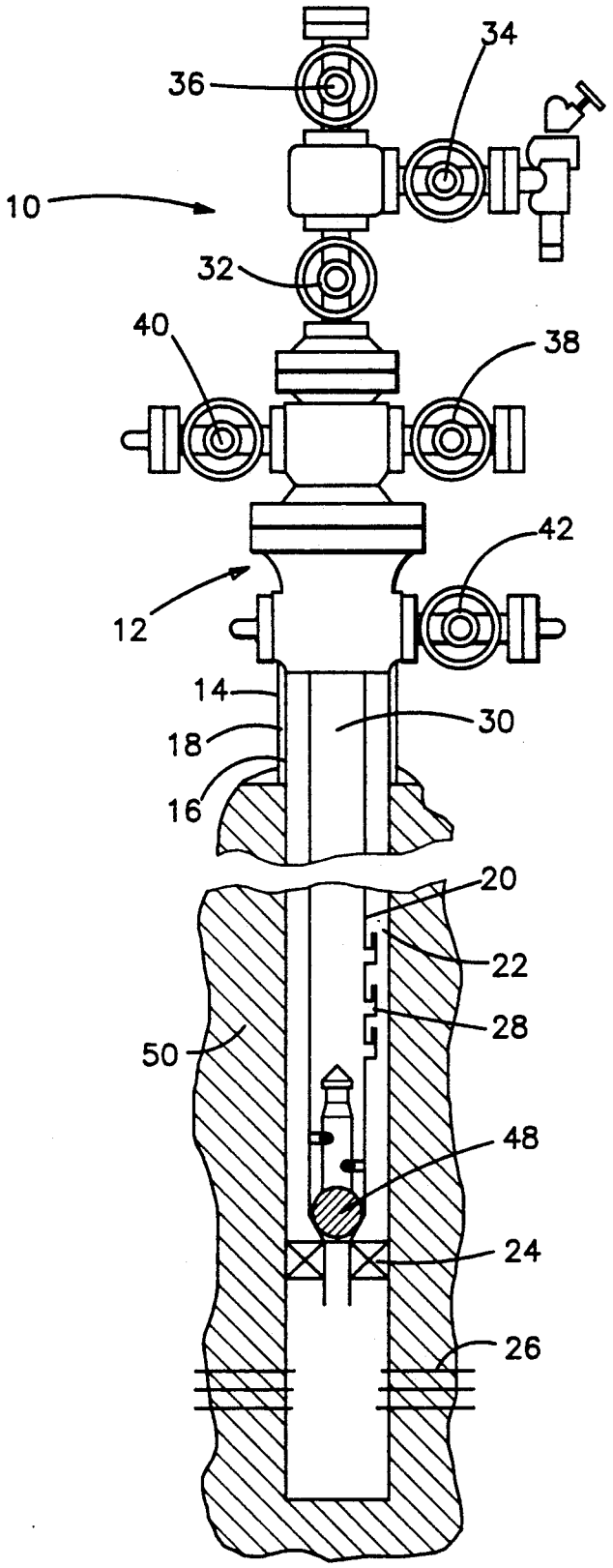
FIG. 1 is a partial cross-section indicating the various components of a typical gas-lift well, and wherein a sealing tool according to the invention is installed.

Referring to FIG. 1, a typical gas-lift well is illustrated which will be used to describe the test methods of the present invention. The well includes a christmas tree assembly 10 mounted over a well head 12. The well has surface casing 14 and a production casing 16, set inside the surface casing 14. A primary or outer annular space 18 is defined between the surface casing 14 and the production casing 16.

The well also has production tubing 20 set inside the production casing 16.

A secondary or inner annular space 22 is defined between the production tubing 20 and the production casing 16.

The production tubing 20 is set into a packer 24. The packer 24 blocks flow from a producing formation 26 into the secondary annular space 22.

A gas-lift well typically has mandrels 28, or one way valves, disposed on the production tubing 20. These mandrels allow gas flow in one direction only, from the secondary annular space 22 to the interior space 30 of the production tubing 20.

The christmas tree 10 has a production tubing valve 32, an oil production valve 34 and a pressure source valve 36. The christmas tree 10 also has a secondary annular space valve 38 and may, for example, have a pressure gauge valve 40. The well head has a primary annular space valve 42 and seals which will be more fully described below.

Figure 2:
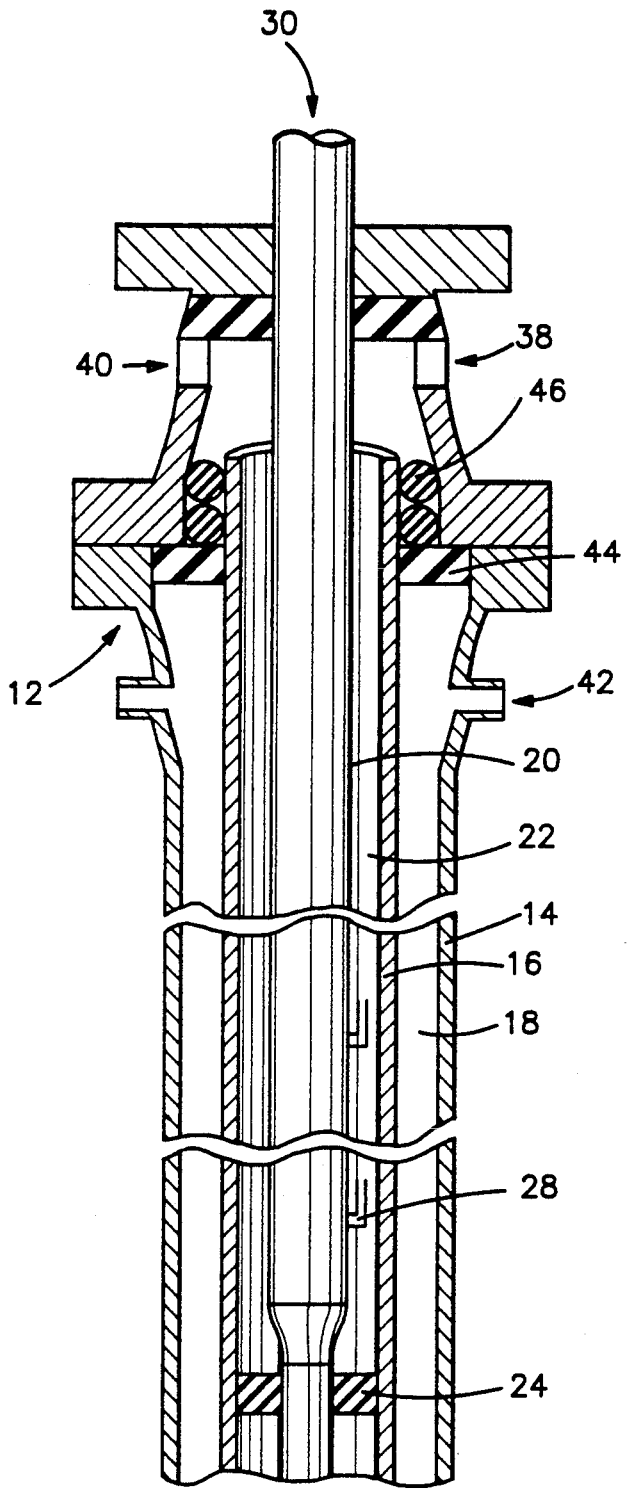
FIG. 2 is a cross-sectional view of a seal structure of the well head of FIG. 1.

Referring to FIG. 2, the well head 12 of the gas-lift well is shown in greater detail and in cross section to illustrate the aforesaid seals. The well head 12 is affixed to the surface casing 14 and has a primary seal 44 disposed on the production casing 16. A secondary seal 46 is also disposed on the production casing 16, below the secondary annular space valve 38. The primary seal 44 and secondary seal 46 serve the function, among others, of directing flow from the secondary annular space valve 38 to the secondary annular space 22.

In normal operation, production of oil through the production tubing 20 is stimulated through the injection of gas through the inner annular space valve 38. The injected gas flows into the inner annular space 22 and enters the production tubing 20 through the mandrels 28, which allow one way gas flow into the production tubing 20. The injected gas enters the production tubing 20 and stimulates the migration of oil to the surface.

The methods for testing, according to the invention, will now be described with reference to the foregoing gas-lift well.

The method, according to the invention, starts with a test of the production tubing 20 (FIG. 1). The procedure may be carried out with a derrick (not shown) in place over the well. The production tubing 20 of the well may be filled with a densified fluid, such as light crude oil or water in order to keep the pressure of the formation in balance. The density of this fluid can be adjusted, if necessary, through means which are well known in the art.

According to the invention, the production tubing 20 is opened to communication through the production tubing valve 32 and the pressure source valve 36. A sealing tool 48 is disposed at a desired location in the production tubing 20. The oil production valve 34 is closed. The primary annular space valve 42 may also, optionally, be closed. The secondary annular space valve 38 is opened.

A predetermined test pressure is then applied to the interior space 30 of the production tubing 20 from a pressure source, preferably a pumping unit, (not shown) connected to the pressure source valve 36.

The test pressure is determined based on the specifications of the tubing being tested, and may be established by the manufacturer of the tubing. The test pressure is preferably maintained for a period of time for example in the range of 15–25 minutes.

The test pressure in the production tubing 20 is monitored, through any means known in the art, for pressure drops.

The secondary annular space valve 38 is also monitored for flow, for reasons which will be detailed below.

If a pressure drop is not detected, the integrity of the production tubing 20 is determined.

If a pressure drop is detected, a problem exists at one or more of several locations of the well and related structure. This problem could occur at any of the following locations:

1. The pressure source (pump);
2. Valves 32, 34, 36 in the christmas tree 10;
3. Production tubing 20;
4. Mandrels 28; and/or
5. sealing tool 48.

The actual source of the pressure drop is then determined, according to the invention, through a process of elimination wherein the locations which are easiest to check are checked first.

If, at any point during the process of elimination, a problem is detected at one of the above locations, that problem is corrected and the production tubing is re-tested . If the re-testing shows no pressure drop, the integrity of the remaining locations, including that of the production tubing 20, is ascertained.

The pressure source is tested or inspected through any means known in the art. If the pressure source is a pump, then it may be tested, for example, by running the pump at a low operating pressure against a closed line.

The various valves 32, 34, 36 of the christmas tree 10 are then tested, by any means known in the art.

If no problem has been found with the pressure source or the aforesaid valves, the pressure or absence of flow from the secondary annular space valve 38 is considered to determine further where the problem may be. If the problem were with the production tubing 20 or mandrels 28, flow would occur from the interior space 30 of the production tubing 20 into the secondary annular space 22, and thence through the secondary annular space valve 38.

If no flow is detected, however, then the pressure must be escaping through the sealing tool 48 and into the formation 26. Thus, if no flow is detected from the secondary annular space valve 38, the sealing tool is checked to determine that it has reached the desired location, and also for chips, etc, which may cause leakage. The sealing tool is replaced, if necessary, and the production tubing 20 is re-tested.

If the pressure drop continues, the production tubing 20 and mandrels 28 must be tested section by section until a problem is discovered with the mandrels 28 or production tubing 20 and no further pressure drop occurs after the problem is corrected.

If flow is detected from the secondary annular space valve 38, it must be coming from the production tubing 20, or a faulty mandrel 28 located in the production tubing 20. The production tubing 20 and mandrels 28 are therefore tested as above, section by section, until a problem is discovered and no further pressure drop occurs after the problem is corrected. In this situation, flow from the secondary annular space valve 38 must still be monitored. If, after a section of tubing or mandrel is replaced, flow stops and pressure loss continues, then there is also a problem with the sealing tool 48.

It should be noted that a problem with the sealing tool 48 could be caused by a defect or chip in the surface of the sealing tool 48, or by the sealing tool 48 failing to reach the desired location. As an alternate embodiment, the location of the sealing tool 48 can be monitored as it is placed in the production tubing 20, so that a subsequent problem indicated with the sealing tool 48 will be a defect or chip therein.

After the integrity of the production tubing 20 has been verified, the production casing 16 can then be tested, according to the invention, as described hereinbelow.

Production casing testing is started, with the sealing tool 48 still in place in the production tubing 20, by opening communication through the secondary annular space valve 38 and also through the primary annular space valve 42. The production tubing valve 32 is closed. The disposition of the oil production valve 34 and pressure source valve 36 is not critical to this portion of the procedure.

A predetermined test pressure is applied through the secondary annular space valve 38 to the secondary annular space 22.

The test pressure is determined, as before, according to the specifications of the casing being tested, and the test pressure is again preferably maintained for a predetermined period of time.

The test pressure in the production casing 16 is monitored, through any means known in the art, for pressure drops.

The primary annular space valve 42 is also monitored for flow, for reasons set forth below.

If no pressure drop is detected, the integrity of the production casing is ascertained.

If a pressure drop is detected, however, a problem is indicated at one or more of several locations as follows:

1. primary seal 44 and secondary seal 46 of the well head 12 (FIG. 2);
2. packer 24; and/or
3. production casing 16.

As before, the actual source of the problem is determined through a process of elimination wherein the locations which are easiest to check are checked first.

Also as before, if at any point during the process of elimination, a problem is detected at one of the above locations, that problem is corrected and the production casing is re-tested. If no further pressure drop occurs, the integrity of the remaining locations is established, including that of the production casing 16.

If a pressure drop is detected, the pressure or absence of flow from the primary annular space valve 42, is considered to further determine the source of the problem.

If there is flow from the primary annular space valve 42, the flow must be coming either from filtration through the primary seal 44 and secondary seal 46 or from a leak in the production casing 16 allowing flow into the primary annular space 18. At this stage, the primary seal 44 and secondary seal 46 of the well head are changed and the production casing 16 is re-tested.

Continued pressure drops coupled with flow from the primary annular space valve 42 indicate that the problem is with the production casing 16, which must be tested section by section until a problem with the production casing is discovered and pressure drops stop after the problem is corrected.

If there is no flow from the primary annular space valve 42, then the pressure drop is occurring either through the packer 24 into the formation 26, or through the production casing 16 and into the formation 26 or surrounding environment 50. In this situation, the packer 24 is replaced and the production casing 16 is re-tested. If pressure drops continue, with no flow from the primary annular space valve 42, then there must be a problem with the production casing 16, which must then be tested section by section until a problem with the production casing is discovered and pressure drops stop after the problem is corrected.

It should be noted that these procedures may both be necessary in situations where actual problems exist with both the packer 24 and the primary seal 44 and secondary seal 46 of the well head.

If, for example, pressure drops and flow are detected, the seals 44, 46 are replaced, and pressure drops without flow continue, the packer 24 should be replaced. Conversely, if pressure drops and no flow are detected, the packer 24 is replaced, and pressure drops continue with flow, then the primary seal 44 and secondary seal 46 should be replaced.

Thus, according to the invention, both production tubing 20 and production casing 16 can be tested without removing the tubing, casing, or gas-lift equipment such as mandrels, unless a definite problem with one of these articles is indicated. Testing procedures can therefore be carried out with a reduction in down-time and a resulting increase in operation efficiency of the well.

Figure 3:
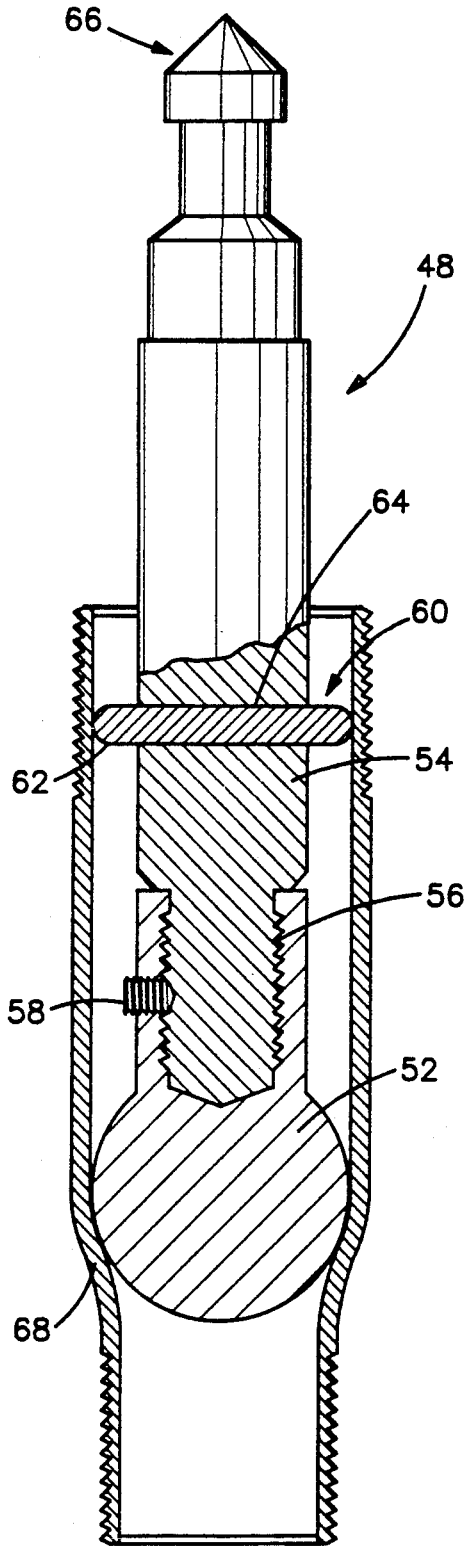
FIG. 3 is a cross-sectional view of the sealing tool of FIG. 1, according to the invention.

Referring now to FIG. 3, a preferred embodiment of the sealing tool 48 for use with the method of the invention will be described.

The sealing tool 48 preferably comprises a ball shaped member 52 mounted to a shaft member 54 through any means known in the art, and preferably through a threaded connection 56. The threaded connection 56 may preferably be held against rotation by a set screw 58.

One or more centralizers 60 are preferably disposed on the shaft member 54 to facilitate positioning of the sealing tool 48 in the production tubing 20. The centralizers 60 may preferably comprise bars 62 of the appropriate length disposed in channels 64 passing through the shaft member 54. Three bars 62 and channels 64 may be disposed, for example, about the shaft member 54 at angles to one another of 120°.

A fishing head 66 is preferably disposed on the shaft member 54 to facilitate removal of the sealing tool 48 from the well.

As shown in FIG. 1, the sealing tool 48 is disposed in the production tubing 20 at a point of reduced inside diameter of the production tubing 20. This reduction of inside diameter may be achieved, for example, with a reduction joint 68 having a reduced inside diameter 70, as shown in FIG. 3.

The ball-shaped member 52 preferably has a diameter smaller than the inside diameter of the production tubing 20, and larger than the reduced inside diameter 70 of the reduction joint 68.

The ball-shaped member 52 is also preferably made of a material which is softer than the production tubing 20 so that no damage is done to the production tubing 20 when the sealing tool 48 is disposed in the well. This material may, for example, be brass.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. In a gas lift fluid well having a well casing a production tubing defining an interior production space disposed within the well casing and defining therewith an annular space therebetween, and an annular packer between the well casing and the tubing to seal the annular space from the well formation, a method for testing the physical integrity of the production tubing and the well casing comprising the steps of:

opening communication from a pressure source to the interior space of the production tubing;

disposing in the interior space of the production tubing at a desired location means for sealing the production tubing;

opening communication between the annular space and a fluid flow monitoring means;

feeding a fluid from the pressure source to the interior space of the production tubing to establish a test pressure in the interior space;

monitoring the pressure in the interior space for a pressure drop; and monitoring any flow of fluid from the annular space to the surface so as to determine fluid leakage from the interior of the production tubing.

2. A method according to claim 1, wherein a pressure drop is detected, further comprising the steps of:

verifying integrity of the pressure source;

verifying integrity of valves contained in a christmas tree structure of the well;

re-applying the test pressure; and monitoring the pressure applied in the interior space for a pressure drop.

3. A method according to claim 2, wherein a pressure drop is detected and no flow from the annular space is detected, further comprising the steps of:

replacing the sealing means;

re-applying the test pressure; and monitoring the pressure in the interior space for a pressure drop.

4. A method according to claim 3, wherein a pressure drop is detected, further comprising the steps of:

removing the production tubing section by section until a problem causing the pressure drop is discovered.

5. A method according to claim 1, further comprising the step of monitoring depth of the sealing means as the sealing means is disposed in the well.

6. A method according to claim 1, wherein the sealing means comprises:

a shaft member;

a ball-shaped member, attached to the shaft member and having a diameter smaller than an inside diameter of the tube and larger than a reduced inside diameter framed at said desired location; and means for centralizing the sealing tool in the tube, the centralizing means being affixed to the shaft member.

7. A method according to claim 1, wherein no pressure drop is detected, further comprising the steps of:

opening communication from a pressure source to the annular space;

closing communication from the interior space of the production tubing;

applying a test pressure to the annular space; and monitoring the pressure in the annular space for a pressure drop.

8. A method according to claim 7, wherein the well includes a surface casing about the well casing defining therewith a second annular space, the method further comprising the steps of:

opening communication between the second annular space and a second fluid flow monitoring means; and monitoring flow from the second annular space to the surface.

9. A method according to claim 8, wherein a pressure drop in the annular space and flow from the second annular space are detected, further comprising the steps of:

changing well head seals of the well;

re-applying the test pressure in the inner space; and monitoring the pressure in the annular space for a pressure drop.

10. A method according to claim 9, wherein a pressure drop in the annular space is detected further comprising the step of testing the well casing section by section until a problem causing the pressure drop is discovered.

11. A method according to claim 8, wherein a pressure drop in the annular space is detected and no flow from the second annular space is detected, further comprising the steps of:

replacing the annular packer disposed in the annular space;

re-applying the test pressure in the annular space; and monitoring the pressure in the annular space for a pressure drop.

12. A method according to claim 11, wherein a pressure drop in the annular space is detected, further comprising the step of testing the well casing section by section until a problem causing the pressure drop is detected.

13. In a gas lift fluid well having a well casing, a production tubing defining an interior production space disposed within the well casing and defining therewith an annular space therebetween, and an annular packer between the well casing and the tubing to seal the annular space from the well formation, a method for testing the physical integrity of the well casing, after the integrity of the production tubing has been established comprising the steps of:

opening communication from a pressure source to the annular space;

closing communication between the interior space of the production tubing and the surface;

applying a test pressure to the annular space;

monitoring the pressure in the annular space for a pressure drop;

opening communication from a second annular space defined between the well casing and a surface casing; and monitoring flow from the second annular space to the surface.

14. A method according to claim 13, wherein a pressure drop and flow from the second annular space are detected, further comprising the steps of:

replacing well head seals of the well;

re-applying the test pressure; and monitoring the pressure for a pressure drop.

15. A method according to claim 14, wherein a pressure drop is detected, further comprising the step of testing the well casing section by section until a problem causing the pressure drop is discovered.

16. A method according to claim 13, wherein a pressure drop is detected and no flow from the second annular space is detected, further comprising the steps of:

replacing the annular packer disposed in the annular space;

re-applying the test pressure; and monitoring the pressure for a pressure drop.

17. A method according to claim 16, wherein a pressure drop is detected, further comprising the step of testing the well casing section by section until a problem causing the pressure drop is detected.

* * * * *